US005847500A

United States Patent [19]

Mera et al.

[11] Patent Number: 5,847,500

[45] Date of Patent: Dec. 8, 1998

[54] ELECTRON GUN FOR COLOR CATHODE RAY TUBE AND METHOD OF MANUFACTURING THE ELECTRON GUN ELECTRODE

[75] Inventors: Takeshi Mera; Masato Miura, both of Mobara; Yoshiaki Takahashi, Chiba, all of Japan

[73] Assignees: Hitachi, Ltd., Tokyo; Hitachi Electronic Devices Co., Ltd., Mobara, both of Japan

[21] Appl. No.: 610,980

[22] Filed: Mar. 1, 1996

[30] Foreign Application Priority Data

Mar. 2, 1995 [JP] Japan ..... 7-043149
Jul. 21, 1995 [JP] Japan ..... 7-185683

[51] Int. Cl.[6] ..... H01J 29/50; H01J 29/46

[52] U.S. Cl. ..... 313/412; 313/414; 313/447; 313/453; 313/458; 313/460

[58] Field of Search ..... 313/409–410, 313/412, 414, 446–47, 448, 452, 453, 458, 459, 460, 449

[56] References Cited

U.S. PATENT DOCUMENTS 4,388,552 6/1983 Greninger ..... 313/414
4,388,553 6/1983 Chen ..... 313/414
4,510,413 4/1985 Yabe et al. ..... 313/409 X
4,656,391 4/1987 Say ..... 313/414
4,712,043 12/1987 Takenaka et al. ..... 313/449 X
4,891,549 1/1990 Kniesser et al. ..... 313/448 X
4,942,334 7/1990 Kimmel et al. ..... 313/448 X

*Primary Examiner*—Sandra L. O'Shea
*Assistant Examiner*—Mack Haynes
*Attorney, Agent, or Firm*—Antonelli, Terry, Stout & Kraus, LLP

[57] ABSTRACT

In an electron gun for a cathode ray tube in which a focus electrode group includes a single platelike electrode having three apertures arrayed in one plane and a thickness equal to a depth of each of the three apertures, a tapered surface is formed on the entrance side and/or exit side of each of the three apertures, the tapered surface having a diameter larger than the aperture diameter and having a linear or curved shape in cross section, and a step which extends in the direction of the depth is formed around an aperture periphery of the tapered surface. With this constitution, the concentricity between each of the tapered surfaces and a respective one of the apertures can be measured with high precision on the basis of the boundary between each of the tapered surfaces and the corresponding one of the steps, thereby improving the precision of measurement of the concentricity between each of the apertures formed in the platelike electrode and the tapered surface formed around the aperture periphery.

17 Claims, 8 Drawing Sheets

ELECTRON GUN FOR COLOR CATHODE RAY TUBE AND METHOD OF MANUFACTURING THE ELECTRON GUN ELECTRODE

BACKGROUND OF THE INVENTION

1. Field of the Invention

The present invention relates to an electron gun for a cathode ray tube, having at least one thick platelike electrode, and to a method of manufacturing an electron gun electrode.

2. Description of the Prior Art

An electron gun for a cathode ray tube includes a plurality of grids for focusing an electron beam emitted from a cathode and accelerating the focused electron beam to make it strike on a phosphor screen, and some of the grids are made from platelike electrodes.

In the case of a color cathode ray tube provided with an in-line type electron gun for emitting three electron beams arrayed in the same plane, each of the platelike electrodes is provided with an in-line set of three apertures through which electron beams pass.

FIG. 8 is a diagrammatic cross-sectional view aiding in describing one example of the structure of such an in-line type color cathode ray tube. The color cathode ray tube shown in FIG. 8 includes a panel 20, a phosphor screen 20*a*, a neck 21, a funnel 22, an electron gun 23, a shadow mask 24 and a deflection yoke 25.

The electron gun 23 includes cathodes 23*a*, a first grid 23*b*, a second grid 23*c*, a third grid 23*d*, a fourth grid 23*e*, a fifth grid 23*f*, a sixth grid 23*g* and a shield cap 23*h* all of which are aligned along a common central axis and arranged in that order.

As shown in FIG. 8, each of the first grid 23*b*, the second grid 23*c* and the fourth grid 23*e* has a structure in which three apertures are formed in line in one plate.

Three electron beams emitted from the three cathodes 23*a* are modulated according to the intensity of an image signal applied to the first grid 23*b*, and the modulated electron beams are subjected to predetermined focusing and acceleration by both a prefocus lens formed by the second grid 23*c* and a main lens formed by the third grid 23*d*, the fourth grid 23*e*, the fifth grid 23*f* and the sixth grid 23*g*.

The three electron beams emitted from the electron gun 23 are deflected horizontally and vertically by the deflection yoke 25, and the deflected electron beams are subjected to color selection through the shadow mask 24 and strike on a three-color phosphor mosaic which constitutes the phosphor screen 20*a*, thereby reproducing an image.

FIGS. 9(*a*) and 9(*b*) are explanatory views of an example of the constitution of a conventional plate like grid which constitutes part of an electron gun. FIG. 9(*a*) is a front elevational view of the grid as viewed on the side of cathodes in the direction of a phosphor screen, and FIG. 9(*b*) is a cross-sectional view taken along line C–C' of FIG. 9(*a*).

A platelike grid 60 is obtained by punching three in-line apertures (a center aperture 31 and side apertures 32*a* and 32*b*) into one plate by press work.

If an aperture is formed by press punching work which is commonly practiced, as shown in FIG. 9(*b*), a predetermined aperture having a uniform sheared portion 1*a* is formed to extend to a certain depth from the side of the plate from which a punch for press work is inserted, but an irregular aperture (a ruptured portion 1*b*) is formed by rupture in a portion which extends from the certain depth to the side of the plate from which the punch is projected.

If the grid is manufactured by the press punching work which is commonly practiced, the amount of formation of the ruptured portion 1*b* is small and no great problem occurs in terms of the characteristics of the electron gun, as far as the thickness of a plate to be punched is of the order of 0.5 mm. However, if such thickness is not less than 0.8 mm, the amount of formation of the ruptured portion 1*b* becomes larger and no stable shape suited to an aperture is obtained, so that the formation of an electric field will be adversely affected.

For this reason, in a conventional grid, two plates are bonded to each other so that the sheared portions are located on the entrance side and the exit side of the grid.

FIGS. 10(*a*) and 10(*b*) are explanatory views aiding in describing a conventional two-plate bonded type of grid which constitutes part of an electron gun. FIG. 10(*a*) is a front elevational view, and FIG. 10(*b*) is a cross-sectional view taken along line D–D' of FIG. 10(*a*).

The grid shown in FIGS. 10(*a*) and 10(*b*) includes a center aperture 31, side aperture 32*a* and 32*b* and plates 60 and 60'.

This grid includes the two plates 60 and 60', which are bonded to each other. The grid is prepared by forming the three apertures 31, 32*a* and 32*b* in each of the two plates 60 and 60' by press work and bonding the plates 60 and 60' to each other after the press work.

As described above, in the punching of an aperture into a plate by press work, the side of the plate in which a punch is inserted is sheared to form an aperture of predetermined shape, proximate to the insertion side but the side of the plate from which the punch is projected is ruptured to form an aperture of irregular shape proximate to the projection side.

For this reason, both plates 60 and 60' are welded to each other with the punch-insertion sides, i.e., the sheared sides, of both plates 60 and 60', being faced outside in opposite directions, thereby preparing an integrated grid.

FIG. 11 is a partial cross-sectional view showing on an enlarged scale the aperture formed in the platelike grid shown in FIG. 10(*b*). The plate 60 has the sheared portion 1*a* proximate to the insertion side and the ruptured portion 1*b*, while the plate 60' has a sheared portion 1*a*' proximate to the insertion side and a ruptured portion 1*b*' proximate to the projection side.

As shown in FIG. 11, the platelike grid is prepared by integrating the two plates 60 and 60' by welding, with the ruptured portions 1*b* and 1*b*' of the electron beam passage holes formed in the respective plates 60 and 60' being faced each other in an aligned state and the sheared portions 1*a* and 1*a*' being faced outside in opposite directions. This structure makes it possible to avoid irregular reflection of electron beams and formation of irregular electric fields.

However, the manufacture of such a two-plate bonded type of grid needs a larger number of steps and a cost increase. In addition, the bonding step involves a lower in precision.

This kind of electron gun for a cathode ray tube is disclosed in, for example, Japanese Patent Laid-Open Nos. 242051/1992 and 62611/1993.

SUMMARY OF THE INVENTION

The above-described platelike electrode according to the prior art is produced by the process of forming three apertures in each of two plates and bonding both plates to each other, so that a considerable precision is required during assembly. In addition, the required number of working steps is large compared to an integrally formed product.

If press punching work is applied to a thick plate in order to improve the degree of integration, a ruptured portion occurs which is inferior to a sheared portion in the precision of a hole diameter as well as in the precision of the center of an aperture with respect to the central axis of the orbit of an electron beam.

In addition, different amounts of ruptured portions are formed under different conditions of individual press dies used for working electrodes.

As described above, the ruptured portion formed on the inside surface of the aperture involves a degradation in the precision of the hole diameter and a degradation in the precision of the center of the aperture with respect to the central axis of the orbit of an electron beam, with the result that the focusing characteristics of the electron gun are lowered.

In addition, the entrance side and/or the exit side of the aperture is floned to form a tapered surface having a linear or curved shape in cross section, thereby preventing the focusing action of an electron beam from being adversely affected by the concentration of electric fields on the edge of the aperture.

However, this tapered surface is formed by using a forming punch different from the aforementioned hole-forming punch in another step after the step of press-punching the aperture, which hole-forming punch and tapered surface forming punch may be applied non-concentrically so that the concentricity between the tapered surface and the aperture may be lowered.

In the process of manufacturing such an electrode, a sample is extracted to measure the concentricity between the center of each tapered surface of the sample and the center of the corresponding aperture of the sample, and the concentricity is adjusted to be maintained within an allowable range.

Conventionally, the boundary between each tapered surface and the inside surface (the even portion of an aperture) of the corresponding aperture is simply measured by using a shape measuring device, because the boundary between each tapered surface and the inside surface (the even portion of the aperture) of the corresponding aperture is not definite and it is difficult to exactly measure the concentricity between the tapered surface and the aperture. However, in this case as well, it is difficult to recognize the point of intersection of each tapered surface and the inside surface of the corresponding aperture, and particularly in the case of a curved tapered surface, the concentricity is difficult to measure.

As described above, the conventional platelike electrode has the problem that it is difficult to ensure the concentricity between the aperture and the tapered surface formed around the aperture periphery, and that cathode ray tubes which use electron guns including such grids involve non-uniform focusing characteristics.

A first object of the present invention is to solve the above-described problems of the prior art and provide an electron gun for a cathode ray tube which is improved in the concentricity between an aperture formed in a platelike electrode and a circumferential surface formed around the aperture.

A second object of the present invention is to solve the above-described problems of the prior art and provide an electron gun for a cathode ray tube which uses a platelike electrode of thickness 0.8 mm or more having at least one aperture formed to have a uniform and desired size and shape, wherein the inside surface (internal circumferential surface) of the at least one aperture and peripheral portions of respective apertures formed in opposite sides of the electrode being are formed evenly and with high dimensional precision.

To achieve the above objects, in an electron gun for a cathode ray tube according to a first aspect of the present invention, convergence electrodes include a single platelike electrode having an aperture and a thickness equal to a depth of the aperture. The entrance side and/or exit side of the aperture is tapered and the taper has a diameter larger than the aperture diameter and a linear or curved shape in cross section. Further, a step which extends in the direction of the depth is formed around a periphery of the aperture.

An electron gun for a cathode ray tube according to a second aspect of the present invention includes a single platelike electrode having three apertures arrayed in one plane and a thickness equal to a depth of each of the three apertures. In such an electron gun, the entrance side and exit side of each of the three apertures are both tapered and they have diameters larger than the aperture diameter, and each of opposite side apertures has a non-circular shape having a longer axis in a direction in which the three apertures area arrayed, and an inside surface of each of the three apertures is either one of an even surface and a recessed surface extending along the inside surface.

A method of manufacturing an electron gun electrode for a cathode ray tube according to a third aspect of the present invention, includes the steps of forming a hole in a single platelike electrode having three apertures arrayed in one plane and a thickness equal to a depth of each of the three apertures, by press punching using a punch having a diameter equal to or slightly greater than a desired hole diameter, tapering opposite sides of the hole, i.e., the entrance and exit sides by using a punch having a tapering portion which extends from a portion smaller in diameter than the hole to a portion larger in diameter than the hole, each of the tapers having a diameter larger than the diameter of the apertures, and applying burnishing to the hole on the opposite sides thereof by using a burnishing punch having a swollen portion having a spherical shape corresponding to the aperture diameter or a non-spherical shape having a longer axis in a direction in which the three apertures are arrayed, thereby pressing and moving an excess metal produced in the tapering step toward a central portion of an inside surface of the hole and forming an aperture having a desired hole diameter and shape.

BRIEF DESCRIPTION OF THE DRAWINGS

FIG. 3(*a*) is a cross-sectional view showing the state in which an aperture is formed in one plate by press punching;

FIG. 3(*b*) is a diagrammatic view of a working process, aiding in describing the formation of a tapered surface and a step on one side of a platelike electrode by press;

FIG. 3(*c*) is a partial cross-sectional view aiding in describing the shape of the aperture of the platelike electrode which has the tapered surface and the step formed on the one side;

FIG. 3(*d*) is a diagrammatic view of a working process, aiding in describing the formation of a tapered surface and a step on the other side of the platelike electrode by press;

FIG. 7(*b*) is a partial explanatory view showing the second embodiment of the method of manufacturing the platelike electrode according to the present invention;

FIG. 7(*c*) is a partial explanatory view showing the second embodiment of the method of manufacturing the platelike electrode according to the present invention;

FIG. 7(*d*) is a partial explanatory view showing the second embodiment of the method of manufacturing the platelike electrode according to the present invention;

FIG. 7(*e*) is a partial explanatory view showing the second embodiment of the method of manufacturing the platelike electrode according to the present invention;

DETAILED DESCRIPTION OF THE PREFERRED EMBODIMENTS

Figure 1:
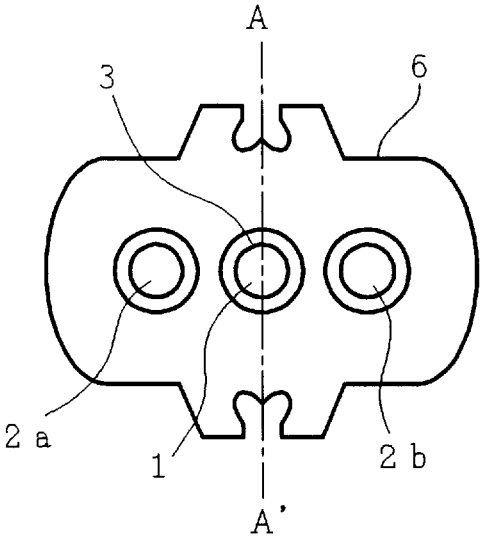
FIGS. 1(*a*) and 1(*b*) are explanatory views of a first embodiment of a platelike focus electrode which constitutes part of an electron gun for a cathode ray tube according to the present invention, and FIG. 1(*a*) is a front elevational view and FIG. 1(*b*) is a cross-sectional view taken along line A–A' of FIG. 1(*a*)
Figure 1:
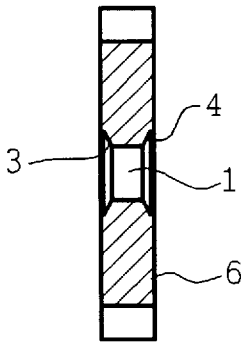

In the constitution of the aforementioned first aspect of the present invention, the entrance side and/or exit side of the aperture is a tapered circumferential surface and has a larger diameter and a linear or curved shape in cross section, and the step which extends in the direction of the depth is formed around the end of the aperture. Accordingly, the focusing action of an electron beam is prevented from being adversely affected by the concentration of electric fields on the edge of the aperture.

In addition, the concentricity between the circumferential tapered surface and the aperture can be measured with high precision on the basis of the boundary between the circumferential tapered surface and the step which is formed around the aperture edge to extend in the depth direction.

In the constitution of the second aspect of the present invention, the tapers are respectively formed around the ends of each of the three apertures on both the entrance side and the exit side of each of the three apertures, the tapers having diameters larger than those of the respective aperture ends. Accordingly, the shapes of the respective apertures on the entrance side and the exit side of each of the three apertures are highly precise and symmetrical. In addition, each of the side apertures has a non-circular shape having a longer axis in the direction in which the three apertures are arrayed, and the inside surface of each of the three apertures is either one of an even surface and a recessed surface extending along the inside surface. Accordingly, the focusing characteristics of the electron beams passing through the respective apertures are prevented from being adversely affected.

In the constitution of the third aspect of the present invention, at least one hole is first formed in a single electrode plate by press punching using a punch having a diameter equal to or slightly greater than a desired hole diameter, and tapers each having a diameter larger than the diameter of the corresponding one of the apertures are formed around the peripheries of the respective apertures on the opposite sides of the hole by using a punch having a tapering portion which extends from a portion smaller in diameter than the hole to a portion larger in diameter than the hole, whereby an excess metal present at the ends of the hole is pressed inwardly of the hole.

Then, by applying burnishing to the hole on the opposite sides thereof by using a burnishing punch having a swollen portion having a spherical shape corresponding to the diameter of an aperture or a non-spherical shape corresponding to the cross-sectional shape of the aperture, the excess metal produced in the aforesaid tapering step is moved toward the central portion of the inside surface of the hole, so that since the excess metal does not project in the hole, a high-precision aperture is obtained.

The present invention is intended to form an aperture in a single plate having a thickness of, for example, 0.8 mm or more with high precision. However, the present invention can be similarly applied to either an electrode using a plate thinner than the aforesaid thickness or a two-plate bonded type of electrode.

A platelike electrode according to the present invention is prepared in the following manner. After a temporary hole has been formed in one electrode plate by a press punch having a diameter smaller than a desired hole diameter, a greater part of the ruptured surface produced by the press punching is worked into an even inside surface by shaving.

After that, a circumferential surface such as a tapered having a linear or curved shape in cross section is formed around each of the peripheries of both apertures, which were formed by the hole by a punch, i.e., beveling is performed.

At this time, steps which extend in the depth direction of the plate are formed around the respective aperture peripheries.

Incidentally, the formation of such steps may be performed before shaving.

In the case of an electrode made from a thin plate having a circumferential surface on only one side, first, after a recess having a step of slight depth has been formed in the same shape as an aperture coaxially with the circumferential surface, the aperture may be formed by press punching work which is commonly practiced. Incidentally, the order of the formation of the recess and the press punching work may be reversed.

According to a cathode ray tube including an electron gun using such a platelike electrode, an electron beam having uniform focusing characteristics can be obtained, so that a high-quality image can be reproduced. In addition, since the concentration of electric fields on the aperture peripheries is suppressed, withstand voltage characteristics can also be improved.

The present invention is not limited to a focus electrode and can also be applied to other platelike electrodes.

Embodiments of the present invention will be described below in detail with reference to the accompanying drawings.

FIGS. 1(*a*) and 1(*b*) are explanatory views of a first embodiment of a platelike focus electrode which constitutes part of an electron gun for a cathode ray tube according to the present invention. FIG. 1(*a*) is a front elevational view, and FIG. 1(*b*) is a cross-sectional view taken along line A–A' of FIG. 1(*a*).

The first embodiment shown in FIGS. 1(*a*) and 1(*b*) includes a center aperture 1, side apertures 2*a* and 2*b*, tapered portions (beveled portions) 3 and 4 formed on the opposite sides of the center aperture 1, and a platelike electrode 6. Each of the tapered portions 3 and 4 which represent circumferential surfaces may have a linear or curved shape in cross section.

Figure 2:
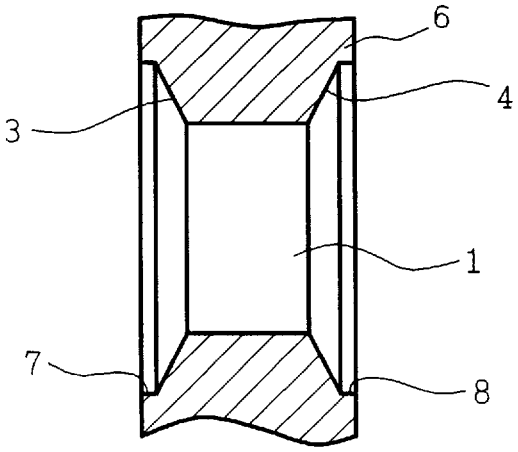
FIG. 2 is a partial cross-sectional view showing on an enlarged view the aperture shown in FIG. 1(*b*)

FIG. 2 is a partial cross-sectional view showing on an enlarged view the electron beam passage hole shown in FIG. 1(*b*). In FIG. 2, reference numerals 7 and 8 denote steps, respectively, and the same reference numerals are used to denote the same portions as those shown in FIGS. 1(*a*) and 1(*b*).

As shown in FIGS. 1(*a*), 1(*b*) and 2, the center aperture 1 and the side apertures 2*a* and 2*b* are arrayed in line. Incidentally, the center aperture 1 may be of circular shape, and each of the side apertures 2*a* and 2*b* may be of ellipsoidal shape-having a longer axis in the in-line direction.

The inside surface of each of the center aperture 1 and the side apertures 2*a* and 2*b*, all of which are formed in the platelike electrode 6, has the tapered surfaces 3 and 4 on opposite sides (on the entrance side and exit side), and the respective tapered portions 3 and 4 have the steps 7 and 8 each of which extends inwardly in the thickness direction of the platelike electrode 6.

Specific size examples of the first embodiment will be described below.

In the case of an electron gun to be accommodated into a color cathode ray tube the neck of which has a tube diameter of 29 mm, each of the center aperture 1 and the side apertures 2*a* and 2*b* has an inside diameter of 4.0 mm, and the hole pitch of these apertures is 5.47 mm.

The thickness of the platelike electrode 6 is 1.0 mm, the depth of beveling of each of the aperture portions on the opposite ends of each of the apertures is 0.07 mm, and the depth of each of the steps is 0.01 mm.

According to these size settings, substantial ruptured portions are not observed, and the precision of the concentricity between the apertures formed on the opposite sides of the electrode plate is improved. The obtained cathode ray tubes has good focusing characteristics, good electrode shapes and highly uniform sizes (reduced size dispersion).

A first embodiment of a method of manufacturing an electron gun electrode according to the present invention will be described below with reference to FIGS. 3(*a*) to 3(*d*).

Figure 3:
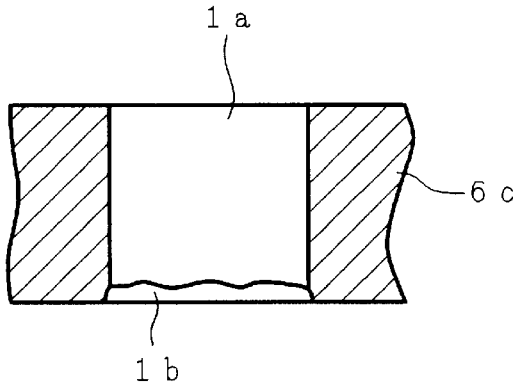
FIGS. 3(*a*) to 3(*d*) are explanatory views of a first embodiment of a method of manufacturing an electron gun electrode according to the present invention.
Figure 3:
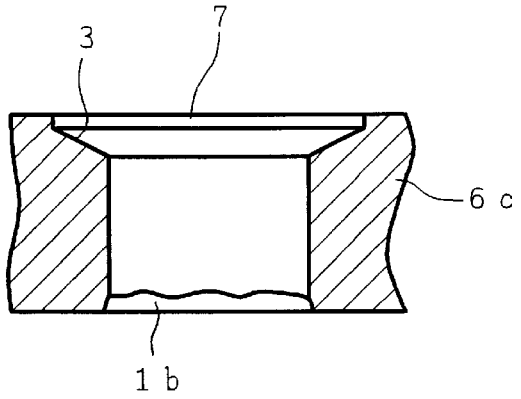
Figure 3:
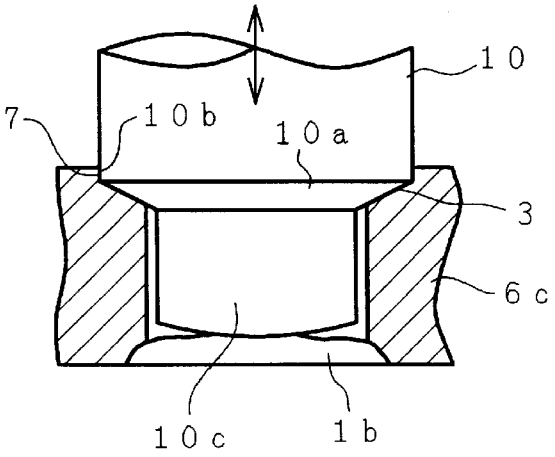
Figure 3:
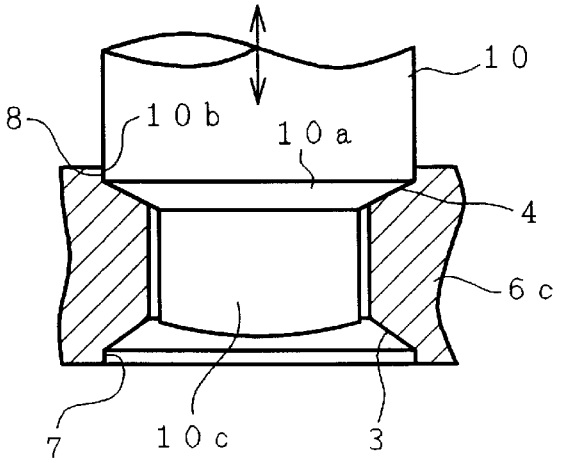

FIG. 3(*a*) is a cross-sectional view showing the state in which an aperture is formed in one plate by press punching. Reference numeral 1*a* denotes a sheared portion, reference numeral 1*b* denotes a ruptured portion, and reference numeral 6*c* denotes a plate.

As shown in FIG. 3(*a*), by applying press punching from above as viewed in FIG. 3(*a*), the sheared portion 1*a* is formed on the side of the plate 6*c* in which a press punch is inserted, and the ruptured portion 1*b* is formed on the side of the plate 6*c* from which the press punch is projected. In this example, the thickness of the sheared portion 1*a* is not less than about 80% of the thickness of the plate 6*c*.

FIG. 3(*b*) is a diagrammatic view of a working process, aiding in describing the formation of a tapered surface and a step on one side of a platelike electrode by press. In FIG. 3(*b*), reference numeral 3 denotes the tapered surface, reference numeral 7 denotes the step, reference numeral 10 denotes a punch, reference numeral 10*a* denotes a tapered-surface working portion, reference numeral 10*b* denotes a step working portion, and reference numeral 10*c* denotes a guide.

As shown in FIG. 3(*b*), the punch 10 has the guide 10*c* to be inserted into the aperture of the platelike electrode worked in the state shown in FIG. 3(*a*), the tapered-surface working portion 10*a* having a shape corresponding to the tapered surface, and the step working portion 10*b* having a shape corresponding to the step.

By pressing the aperture at a predetermined pressure by using this punch 10, the tapered surface 3 and the step 7 is formed on the end of the aperture.

FIG. 3(*c*) is a partial cross-sectional view aiding in describing the shape of the aperture of the platelike electrode which has the tapered surface and the step formed on the one side.

FIG. 3(*d*) is a diagrammatic view of a working process, aiding in describing the formation of a tapered surface and a step on the other side of the platelike electrode by press. In FIG. 3(*d*), reference numeral 4 denotes the tapered surface and reference numeral 8 denotes the step, and the same reference numerals are used to denote the same portions as those shown in FIGS. 3(*b*).

In a manner similar to that described above with reference to FIG. 3(*b*), the tapered surface 4 and the step 8 are formed on the other side by using the punch 10.

Through this work, the platelike electrode 6 having the aperture 1 shown in FIG. 2 is, obtained.

Incidentally, although the tapered surface and the step on either side are formed at the same time, they may be separately formed by using separate punches.

In addition, as a matter of course, the step of working, by burnishing, the inside surface of the aperture into either an even surface or a recessed surface extending along the inside surface may be added to the process of the above-described embodiment. In addition, the above-described embodiment may also be applied to a platelike electrode having a tapered surface formed on only one side.

If the steps are formed in the above-described manner, the concentricity between each of the tapered surfaces and the internal circumferential surface of the aperture can be measured with high precision on the basis of the boundary between each of the tapered surfaces and the corresponding one of the steps.

According to the above-described embodiment, it is possible to readily form an aperture of required shape in a thick electrode plate.

Figure 4:
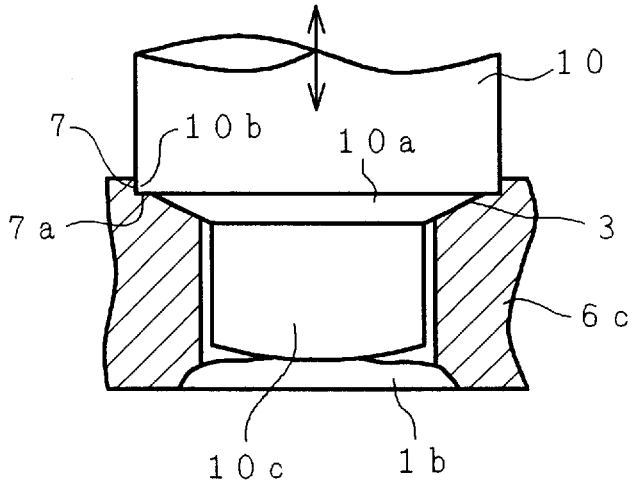
FIG. 4 is a diagrammatic of another working process, aiding in describing the formation of a tapered surface and a step on one side of a platelike electrode by press.

FIG. 4 is a diagrammatic of another working process, aiding in describing the formation of a tapered surface and a step on one side of a platelike electrode by press. As shown in FIG. 4, an even portion 7*a* is provided at the boundary between the tapered surface 3 and the step 7.

By forming these tapered surface and step, it is similarly possible to readily form an aperture of required shape in a thick electrode plate, as in the case of the above-described process.

As is apparent from the above description, according to the first embodiment of the present invention, the precision of measurement of the concentricity between the internal circumferential surface and the tapered surface of each aperture is improved and the characteristics of an electron gun electrode using a single plate are improved, so that it is possible to obtain cathode ray tubes provided with electron guns having high precision and uniform characteristics.

Figure 5:
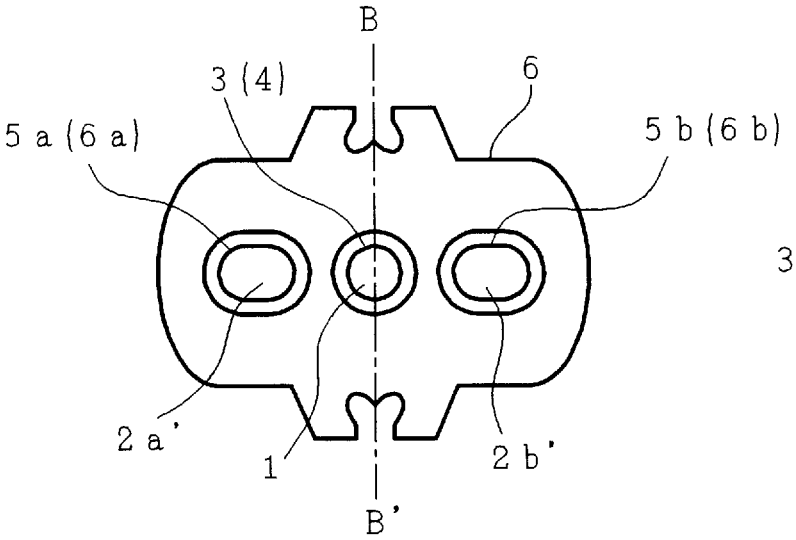
FIGS. 5(*a*) and 5(*b*) are explanatory views of a second embodiment of a platelike focus electrode which constitutes part of an electron gun for a cathode ray tube according to the present invention, and FIG. 5(*a*) is a front elevational view, and FIG. 5(*b*) is a cross-sectional view taken along line B–B' of FIG. 5(*a*)
Figure 5:
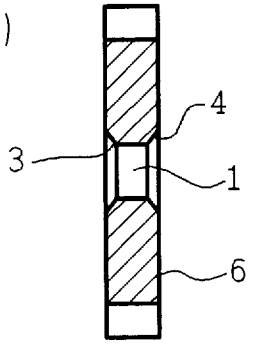

FIGS. 5(*a*) and 5(*b*) are explanatory views of a second embodiment of a platelike focus electrode which constitutes part of an electron gun for a cathode ray tube according to the present invention. FIG. 5(*a*) is a front elevational view, and FIG. 5(*b*) is a cross-sectional view taken along line B–B' of FIG. 5(*a*).

The second embodiment shown in FIGS. 5(*a*) and 5(*b*) includes the center aperture 1, side apertures 2*a*' and 2*b*', tapered portions (beveled portions) 3 and 4 formed on the opposite sides of the center aperture 1, tapered portions (beveled) 5*a* and 6*a* formed on the opposite sides of the side aperture 2*a*', tapered portions (beveled) 5*b* and 6*b* formed on the opposite sides of the side aperture 2*b*', and the platelike electrode 6. Each of the tapered portions may has a linear or curved shape in cross section.

Figure 6:
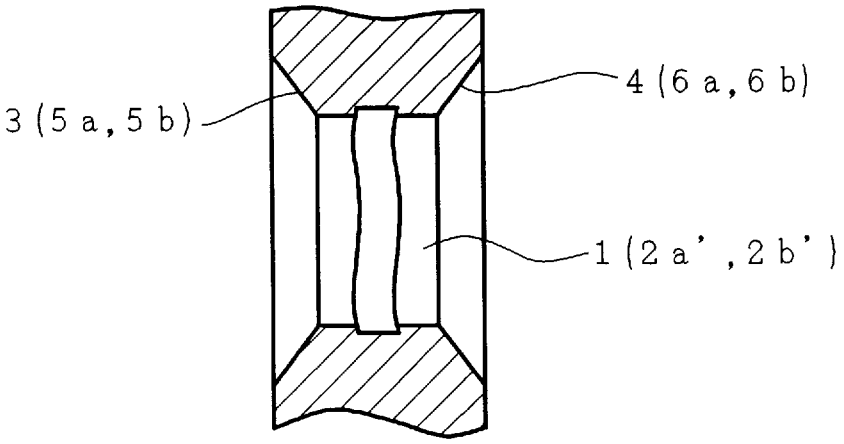
FIG. 6 is a cross-sectional view showing on an enlarged view the apertures of the platelike electrode according to the second embodiment of the present invention.

FIG. 6 is a cross-sectional view showing on an enlarged view the apertures.

As shown in FIGS. 5(*a*), 5(*b*) and 6, the center aperture 1 and the side apertures 2*a*' and 2*b*' are arrayed in line. The center aperture 1 is of circular shape, and each of the side apertures 2*a*' and 2*b*' is of ellipsoidal shape having a longer axis in the in-line direction.

The center aperture 1 and the side apertures 2*a*' and 2*b*', all of which are formed in the platelike electrode 6, have no substantial ruptured surface, and they include even surfaces or recessed surfaces extending along the inside surface.

Specific size examples of the second embodiment will be described below.

In the case of an electron gun to be accommodated into a color cathode ray tube with a neck diameter of 29 mm, the center aperture 1 of the platelike electrode has an inside diameter of 4.0 mm, the side apertures 2*a*' and 2*b*' have a shorter diameter of 4.0 mm and a longer diameter of 4.06 mm, the hole pitch of these apertures is 5.47 mm, the thickness of the electrode 6 is 1.0 mm, and the depth of beveling of the aperture portions on the opposite ends of each of the aperture is 0.04 to 0.09 mm.

According to these size settings, substantial ruptured portions are not observed, and the precision of formation of the apertures on the opposite sides of the electrode plate is improved. The obtained cathode ray tubes has good focusing characteristics, good electrode shapes and highly uniform sizes (reduced size dispersion).

Figure 7:
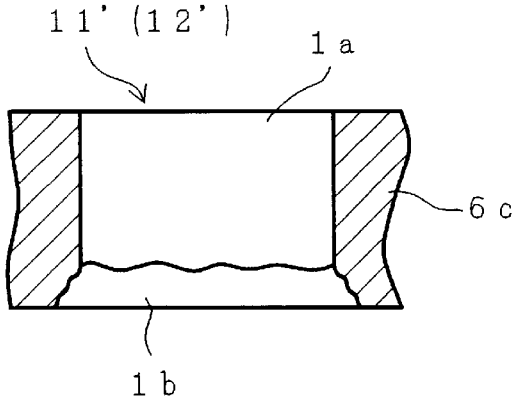
FIG. 7(*a*) is a partial explanatory view showing a second embodiment of a method of manufacturing a platelike electrode according to the present invention.
Figure 7:
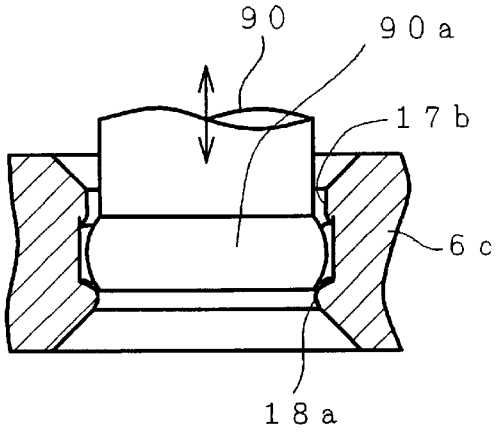
Figure 7:
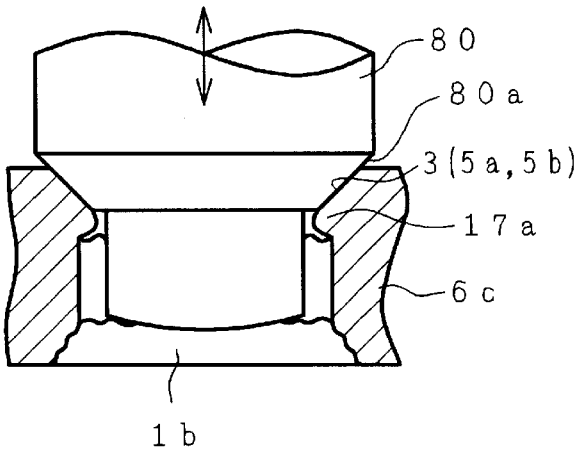
Figure 7:
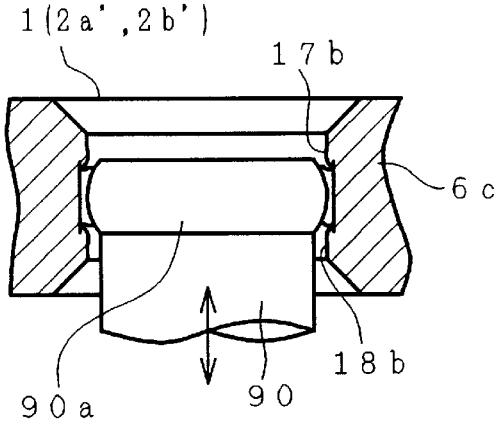
Figure 7:
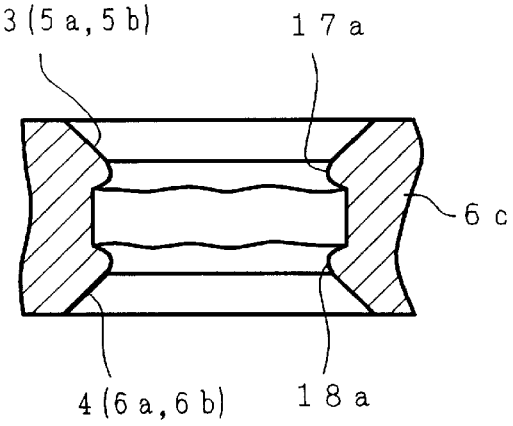
Figure 8:
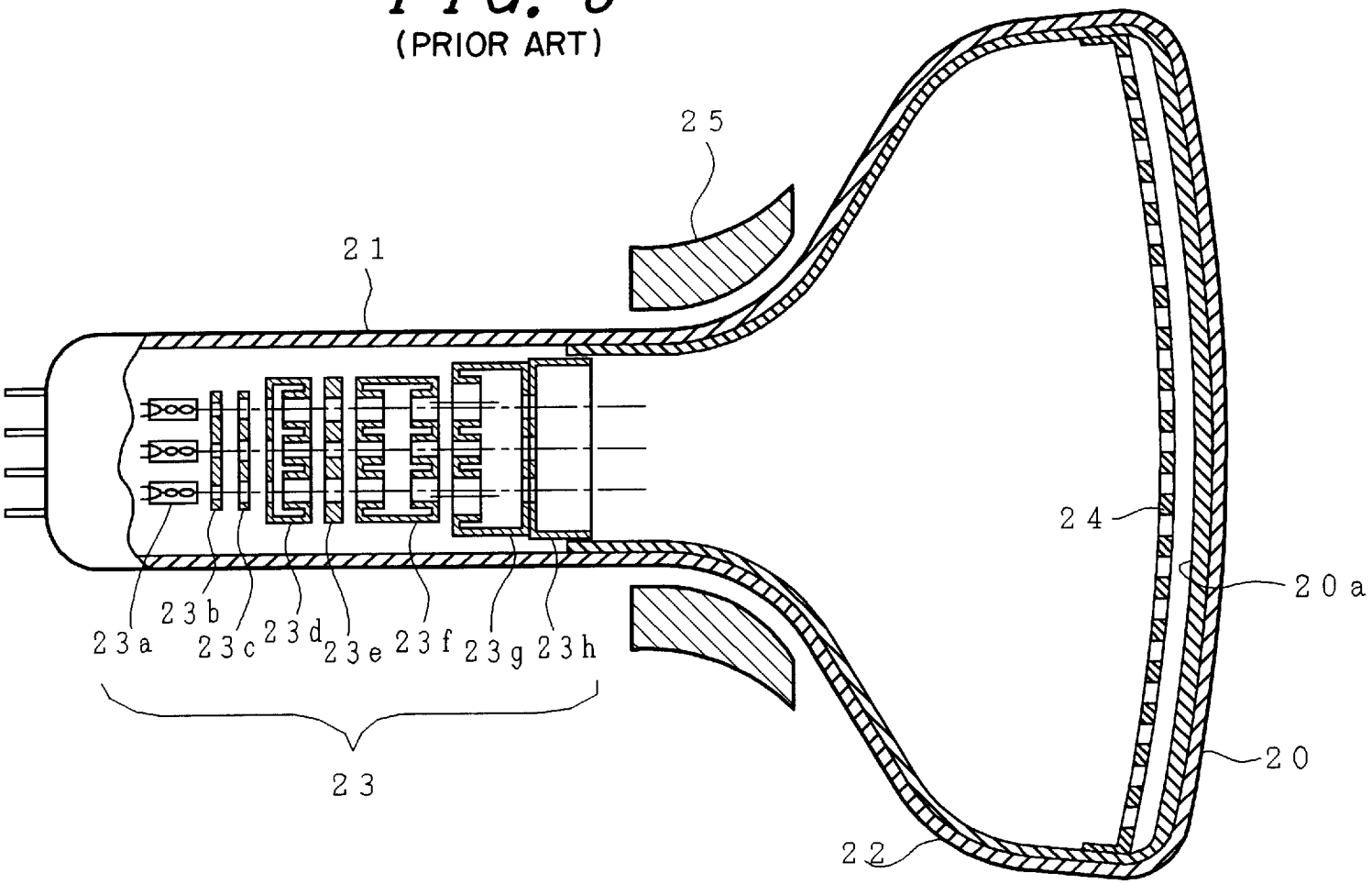
FIG. 8 (PRIOR ART)
FIG. 8 is a diagrammatic cross-sectional view aiding in describing one example of the structure of an in-line type color cathode ray tube.
Figure 9:
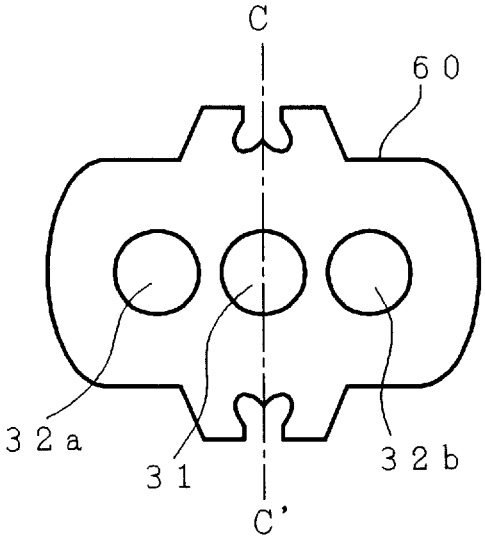
FIG. 9 (a) (PRIOR ART)
FIGS. 9(*a*) and 9(*b*) are explanatory views of an example of the constitution of a conventional platelike grid which constitutes part of an electron gun, and FIG. 9(*a*) is a front elevational view and FIG. 9(*b*) is a cross-sectional view taken along line C–C' of FIG. 9(*a*)
Figure 9:
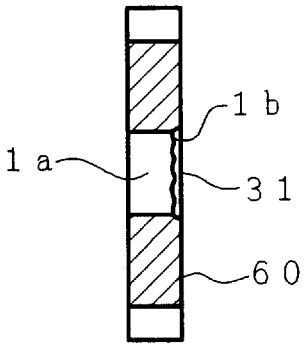
FIG. 9 (b) (PRIOR ART)
Figure 10:
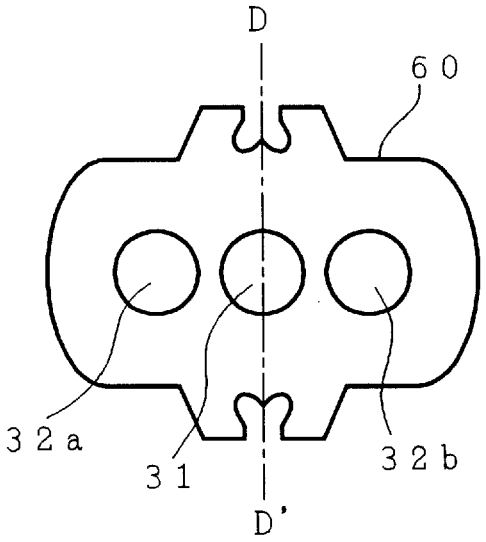
FIG. 10 (a) (PRIOR ART)
FIGS. 10(*a*) and 10(*b*) are explanatory views aiding in describing a conventional two-plate bonded type of grid which constitutes part of an electron gun, and FIG. 10(*a*) is a front elevational view and FIG. 10(*b*) is a cross-sectional view taken along line D–D' of FIG. 10(*a*)
Figure 10:
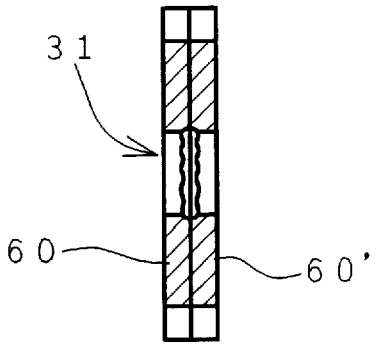
FIG. 10 (b) (PRIOR ART)
Figure 11:
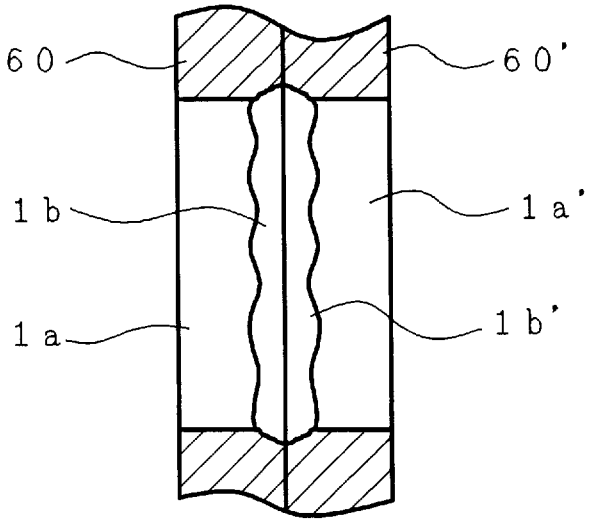
FIG. 11 (PRIOR ART)
FIG. 11 is a partial cross-sectional view showing on an enlarged scale the aperture formed in the platelike grid shown in FIG. 10(*b*).

FIGS. 7(*a*) to 7(*e*) are explanatory views showing one example of a method of manufacturing the platelike electrode according to the second embodiment of the present invention. In FIGS. 7(*a*) to 7(*e*), the same reference numerals are used to denote the same portions as those mentioned previously in connection with the above-described embodiment. In FIGS. 7(*a*) to 7(*e*), reference numerals 17*a* and 18*a* denote excess metals formed by a tapering operation as shown in FIGS. 7(*b*) and 7(*c*), reference numerals 17*b* and 18*b* denote pressed portions formed by forcing the respective excess metals 17*a* and 18*b*, outwardly in a burnishing operation as shown in FIGS. 7(*d*) and 7(*e*) reference numeral 80 denotes a beveling (tapering) punch, reference numeral 80*a* denotes a tapering portion of the punch 80, reference numeral 90 denotes a burnishing punch having a swollen portion, and reference numeral 90*a* denotes the swollen portion of the burnishing punch 90.

First, as shown in FIG. 7(*a*), a hole 11, (12') is formed in the plate 6*c* which constitutes part of an electrode, by press work. As shown, the sheared portion 1*a* is formed on the side of the hole in which a press working punch was inserted, and the ruptured portion 1*b* is formed on the side of the hole from which the punch is projected. At this time, the thickness of the sheared portion is not less than 80% of the thickness of the plate.

Then, as shown in FIG. 7(*b*), one end of the aperture is beveled by the tapering punch 80 having the tapering portion 80*a*, thereby forming the tapered portion 3 (5*a*, 5*b*). At this time, the excess metal 17*a* is formed by forming the tapered portion 3 (5*a*, 5*b*).

Similarly, as shown in FIG. 7(*c*), the other end of the aperture is beveled by the tapering punch 80, thereby forming the tapered portion 4 (6*a*, 6*b*). At this time, the excess metal 18*a* is formed by forming the tapered portion 4 (6*a*, 6*b*).

Then, as shown in FIG. 7(*d*), the burnishing punch 90 having the swollen portion 90*a* of predetermined diameter and shape is pressed into the aperture on one side, thereby working the excess metal 17*a* into the pressed portion 17*b* having a substantially even shape. At this time, the swollen portion 90*a* of the burnishing punch 90 is pressed into the approximately central portion of the aperture.

Similarly, as shown in FIG. 7(*c*), the burnishing punch 90 is pressed into the aperture from the other side, thereby working the excess metal 18*a* into the pressed portion 18*b* having a substantially even shape.

Through the above-described process, the electron beam passage hole 1 (2*a*', 2*b*') is formed which has a predetermined hole diameter, a predetermined aperture shape and high precision.

Incidentally, by selecting a burnishing punch having a swollen portion according to the shape and the size of an aperture to be formed, it is possible to form highly precisely a circular shape, an elliptic shape, an ellipsoidal shape or various other shapes.

According to the second embodiment, it is possible to readily form an aperture of required shape in a thick electrode plate.

As is apparent from the above description, according to the second embodiment of the present invention, the internal circumferential surfaces of each aperture is made smooth and the required hole can be formed with high dimensional precision, whereby an electron gun electrode can be obtained from one plate.

With a cathode ray tube including an electron gun using such an electrode, it is possible to reproduce a high-quality image.

What is claimed is:

1. An electron gun for a cathode ray tube, comprising a single platelike electrode having an aperture, wherein a circumferential surface is formed around at least one of an entrance side and an exit side of said aperture, said circumferential surface having a diameter larger than a diameter of said aperture and having a linear or curved shape in cross section, and a step which extends in a direction of a depth of said aperture is formed around said circumferential surface.

2. An electron gun for a cathode ray tube according to claim 1, wherein said platelike electrode form a focus electrode.

3. An electron gun for a cathode ray tube according to claim 1, wherein said circumferential surface is a tapered surface.

4. An electron gun for a cathode ray tube according to claim 1, wherein an even portion is formed at a boundary between said circumferential surface and said step in a direction perpendicular to said depth direction.

5. An electron gun for a cathode ray tube according to claim 1, wherein an inside surface of said aperture is either one of an even surface and a recessed surface extending along said inside surface.

6. An electron gun for a cathode ray tube comprising a single platelike electrode having three apertures arranged in one plane including a central aperture and two side apertures, wherein a circumferential surface is formed around at least one of an entrance side and an exit side of each of said three apertures, said circumferential surface having a dimension larger than a corresponding dimension of said aperture taken along any direction perpendicular to a depth direction of each of said three apertures and having a linear or curved shape in cross section, and a step which extends in the depth direction is formed around said circumferential surface.

7. An electron gun for a cathode ray tube according to claim 6, wherein each of the two side apertures has a non-circular shape having a longer axis in a direction in which said three apertures are arrayed.

8. An electron gun for a cathode ray tube comprising a single platelike electrode having there apertures arrayed in one plane including a central aperture and two side apertures, wherein both the entrance side and exit side of each of said three apertures are tapered and have dimensions larger than the corresponding dimensions of said apertures, each of the two side apertures has a non-circular shape having a longer axis in a direction in which said three apertures are arrayed, and an inside surface of each of said three apertures having either one of an even surface and a recessed surface extending along said inside surface.

9. A method of manufacturing an electron gun electrode for a cathode ray tube, which includes a single platelike electrode having three apertures arrayed in one plane, comprising the steps of:

forming a hole in said single electrode platelike electrode;

tapering entrance and exit sides of said hole, each of said tapers having a diameter larger than the diameter of said apertures; and applying burnishing to said hole on said entrance and exit sides thereof, thereby forming an aperture having a desired hole diameter and shape.

10. A method according to claim 9, wherein the step of applying burnishing includes forming each of the two side apertures to have a non-circular shape with a longer axis in a direction in which said three apertures are arrayed and an inside surface of each of said three apertures is either one of an even surface and a recess surface extending along said inside surface.

11. A method according to claim 9, wherein the step of tapering includes forming a circumferential surface on the entrance side and exit side of each of said three apertures, said circumferential surface having a diameter larger than a diameter of said aperture periphery and having a linear or curve shape in cross section, and the step of applying burnishing includes forming a step which extends in a direction of said depth around said circumferential surface.

12. A method according to claim 9, wherein the step of forming includes press punching using a punch having a diameter equal to or slightly greater than a desired hole diameter, the step of tapering includes using a punch having a tapering portion which extends from a portion smaller in diameter than said hole to a portion larger in diameter than said hole, and the step of applying burnishing includes using a burnishing punch having a swollen portion with a spherical shape corresponding to a plane shape and the aperture diameter or a non-spherical shape having a longer axis in a direction in which said three apertures are arrayed, thereby pressing and moving an excess metal produced in said tapering step toward a central portion of an inside surface of said hole.

13. An electron gun for a cathode ray tube according to claim 6, wherein each of said apertures includes a press-punched hole, said circumferential surface is a punched-tapered surface and said step is a burnishing-punched surface.

14. An electron gun for a cathode ray tube according to claim 8, wherein each of said apertures includes a press-punched hole, said tapered entrance side and exit side being punched-tapered portions, and the shape of the opposite side apertures being burnishing-punched portions.

15. An electron gun for a cathode ray tube according to claim 8, wherein each of said apertures includes a press-punched hole formed by using a punch having a diameter equal to or slightly greater than a desired hole diameter, said tapered entrance side and exit side being punched-tapered portions formed by using a punch having a tapering portion which extends from a portion smaller in diameter than said hole to a portion larger in diameter than said hole, and the shape of the two side apertures being burnishing-punched portions formed by using a burnishing punch having a swollen portion with a spherical shape corresponding to the aperture diameter or a non-spherical shape having a longer axis in a direction in which said three apertures are arrayed, thereby pressing and moving an excess metal produced in said tapering step toward a central portion of an inside surface of said hole.

16. An electron gun for a cathode ray tube according to claim 1, wherein said circumferential surface is formed around the entrance side and the exit side of said aperture.

17. An electron gun for a cathode ray tube according to claim 6, wherein said circumferential surface is formed around the entrance side and the exit side of each of said three apertures.

* * * * *